US012605036B1

(12) United States Patent
Canisales, Sr.

(10) Patent No.: US 12,605,036 B1
(45) Date of Patent: Apr. 21, 2026

(54) SHOE CLEANING MAT

(71) Applicant: Rudolph Canisales, Sr., Phoenix, AZ (US)

(72) Inventor: Rudolph Canisales, Sr., Phoenix, AZ (US)

( * ) Notice: Subject to any disclaimer, the term of this patent is extended or adjusted under 35 U.S.C. 154(b) by 442 days.

(21) Appl. No.: 18/139,781

(22) Filed: Apr. 26, 2023

(51) Int. Cl.

| | |
|---|---|
| ***A47L 23/26*** | (2006.01) |
| ***A46B 13/02*** | (2006.01) |
| ***A46B 15/00*** | (2006.01) |
| ***A47L 23/02*** | (2006.01) |

(52) U.S. Cl.
CPC ..... *A47L 23/266* (2013.01); *A46B 13/02* (2013.01); *A46B 15/0004* (2013.01); *A46B 15/0036* (2013.01); *A47L 23/02* (2013.01); *A47L 23/263* (2013.01); *A46B 2200/306* (2013.01)

(58) Field of Classification Search
CPC ..... A47L 23/02; A47L 23/266; A47L 23/263; A46B 2200/306; A46B 15/0004; A46B 13/02
USPC ..... 15/21.1
See application file for complete search history.

(56) References Cited

U.S. PATENT DOCUMENTS

| | | | | |
|---|---|---|---|---|
| 8,533,901 | B2 | 9/2013 | Williams | |
| 8,973,197 | B2 | 3/2015 | Omidi | |
| 11,707,178 | B2 * | 7/2023 | Busken-Jovanovich | B08B 3/02 15/320 |
| 2022/0079414 | A1 * | 3/2022 | Desu-Kalyanam | A47L 23/02 |

* cited by examiner

*Primary Examiner* — Katina N. Henson
(74) *Attorney, Agent, or Firm* — Sanchelima & Associates, P.A.; Jesus Sanchelima; Christian Sanchelima

(57) ABSTRACT

A shoe cleaning mat including a housing assembly, a cleaning assembly and an electronic assembly. The housing assembly includes a housing having an opening in a top wall thereof. The cleaning assembly includes brushes equidistantly disposed within the housing. The brushes are connected therebetween through a shaft. The electronic assembly includes a motor, a battery and a sensor. The battery provides power to the motor and the sensor. The sensor is attached to a periphery of the opening of the housing. The motor is actuated when the sensor detects motion. The motor is actuated to move the movable base moving the brushes to clean a shoe introduced through the opening of the housing.

1 Claim, 4 Drawing Sheets

SHOE CLEANING MAT

BACKGROUND OF THE INVENTION

1. Field of the Invention

The present invention relates to a shoe cleaning mat and, more particularly, to a shoe cleaning mat that allows self cleaning of shoes.

2. Description of the Related Art

Several designs for cleaning mats have been designed in the past. None of them, however, includes a sensor to detect presence of a shoe to activate brushes to rotate cleaning the sole of the shoe.

Applicant believes that a related reference corresponds to U.S. Pat. No. 8,973,197 issued for a doormat having motor controlled brushes for cleaning shoes. Applicant believes that another related reference corresponds to U.S. Pat. No. 8,533,901 issued for an automatic shoe cleaning door mat having rotating brush bristles. None of these references, however, teach of a shoe cleaning device comprising a doormat having a battery powered motor which controls rotating brushes, integral LED lights, and a debris or dirt collection tray.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a shoe cleaning mat that includes an electric motor capable of actuating the brushes to rotate back and forth.

It is another object of this invention to provide a shoe cleaning mat that includes a removable collection tray used to collect dirt from the shoe and be cleaned when removed.

It is still another object of the present invention to provide a shoe cleaning mat that includes a housing to protect the electronic assembly of the invention.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
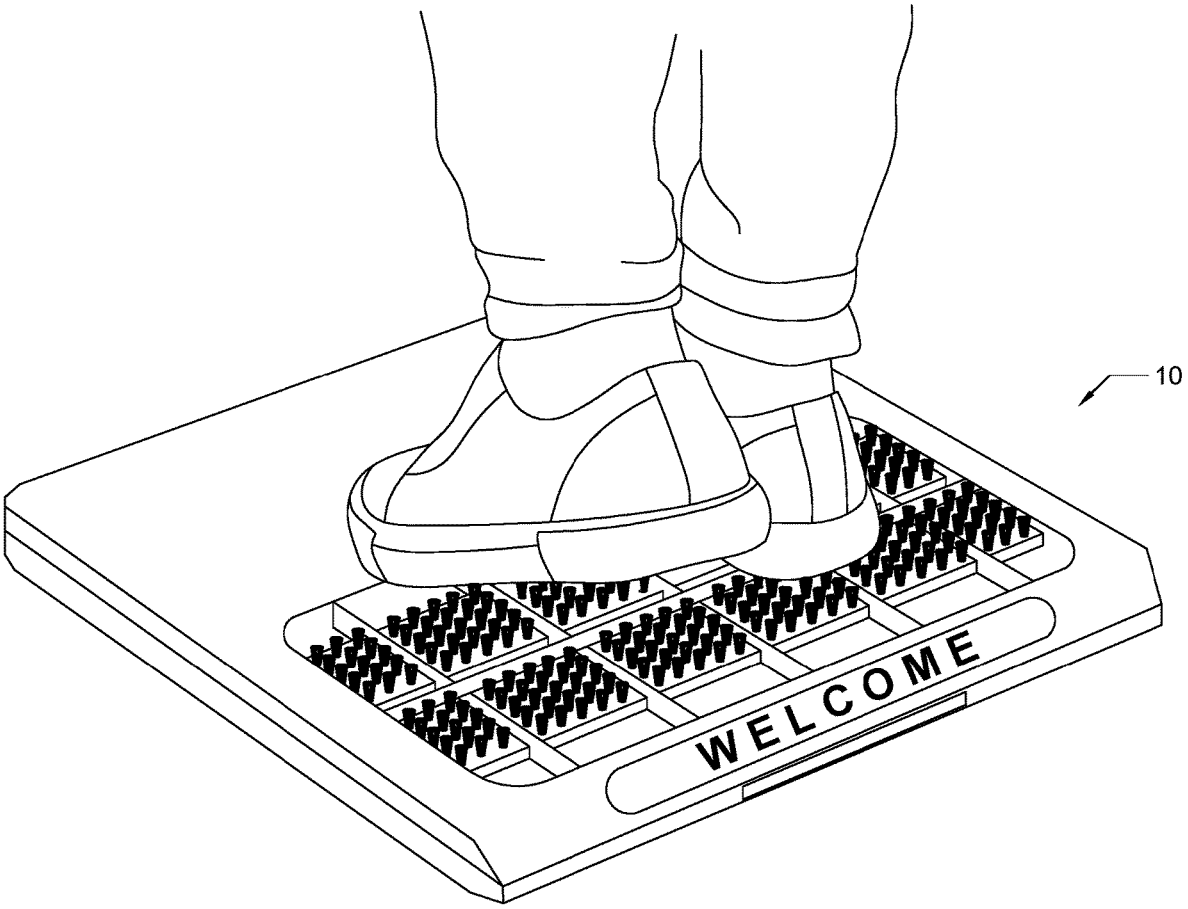
FIG. 1 represents an isometric operational view of the present invention 10 being used by user to clean a shoe.
Figure 2:
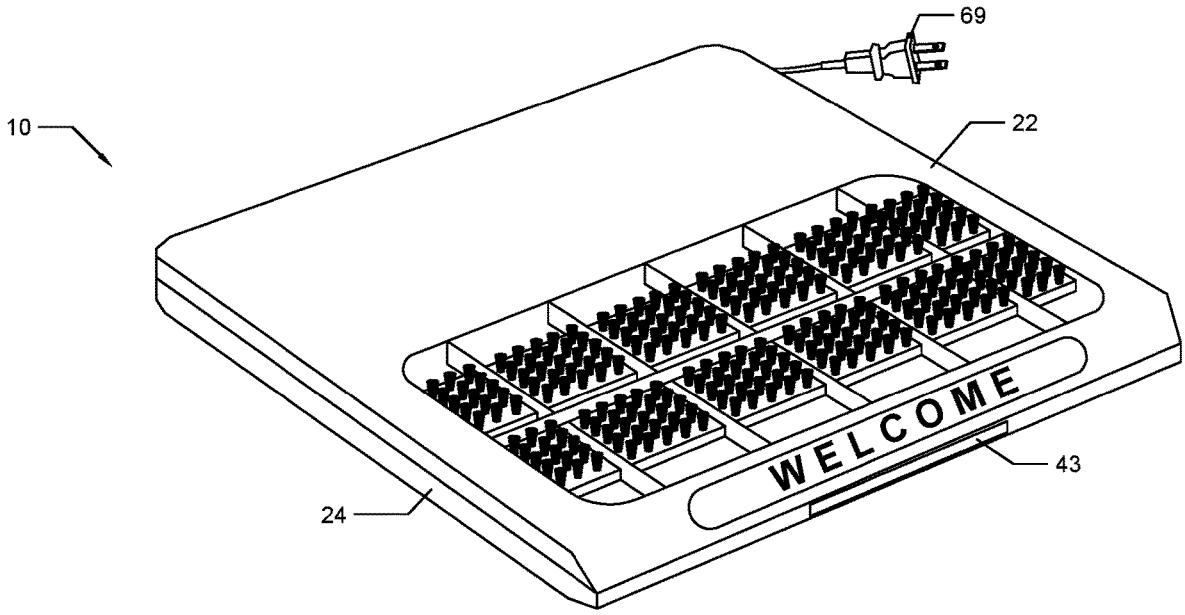
FIG. 2 shows an isometric view of the present invention 10. The present invention includes a housing assembly 20, a cleaning assembly 40 and an electronic assembly 60.
Figure 3:
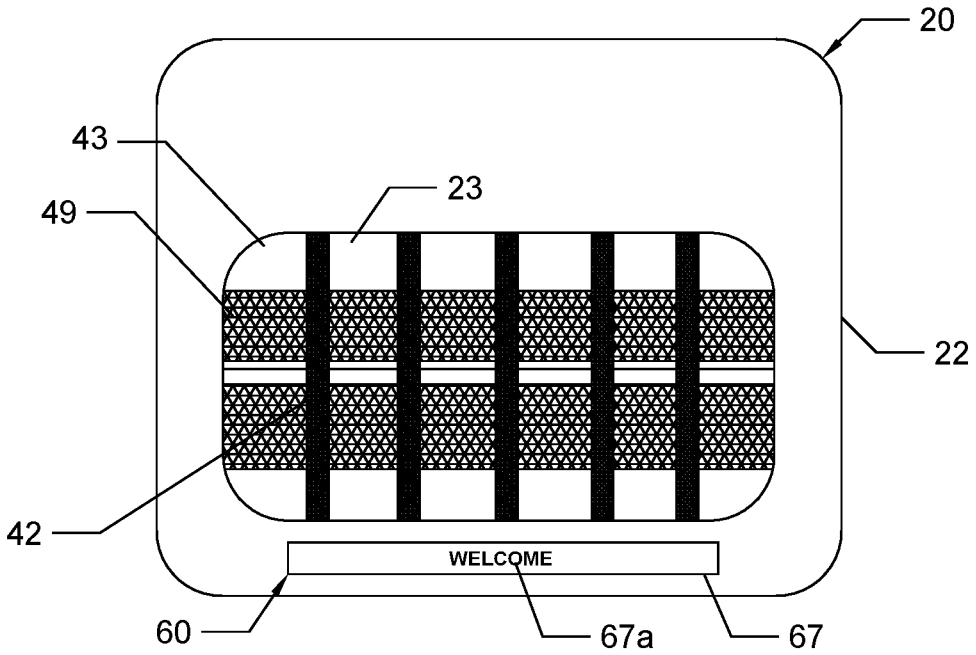
FIG. 3 illustrates a top view of the present invention 10.

Referring now to the drawings, where the present invention is generally referred to with numeral 10, it can be observed that it basically includes a housing assembly 20, a cleaning assembly 40 and an electronic assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The housing assembly 20 may include a top housing 22 and a bottom housing 24. The top housing 22 may have an opening 23. The top housing 22 and the bottom housing 24 may substantially have a rectangular shape with rounded corners. The top housing 22 may be coupled with the bottom housing 24 defining a single housing having a rectangular shape. The top housing 22 may have sidewall and a top wall. The bottom housing 24 may have sidewalls and a bottom wall. The top wall of the top housing 22 may have the opening 23. Opening 23 may allow access to the cleaning assembly 40. Opening 23 may have a rectangular shape with rounded corners. Opening 23 may have such dimensions that allows receiving two shoes therethrough. The top housing 22 and the bottom housing 24 may enclose the cleaning assembly 40 and the electronic assembly 60 therein. The top housing 22 and the bottom housing 24 may preferably be made of stainless steel, mild steel, or any other metal. It also may be suitable for the top housing 22 and the bottom housing 24 to be made of polyurethane, wood, polyvinyl chloride, or any other suitable material. The bottom housing 24 may include anti-slip members 29. In a preferred embodiment anti-slip members 29 may be made of a rubber plastic material. The anti-slip members 29 may be located on corners of the bottommost end of the bottom housing 24. In one embodiment the anti-slip members 29 may be flush with the bottommost end of the bottom housing 24. In another embodiment the anti-slip members 29 protrude outwardly from the bottommost end of the bottom housing 24.

Figure 4:
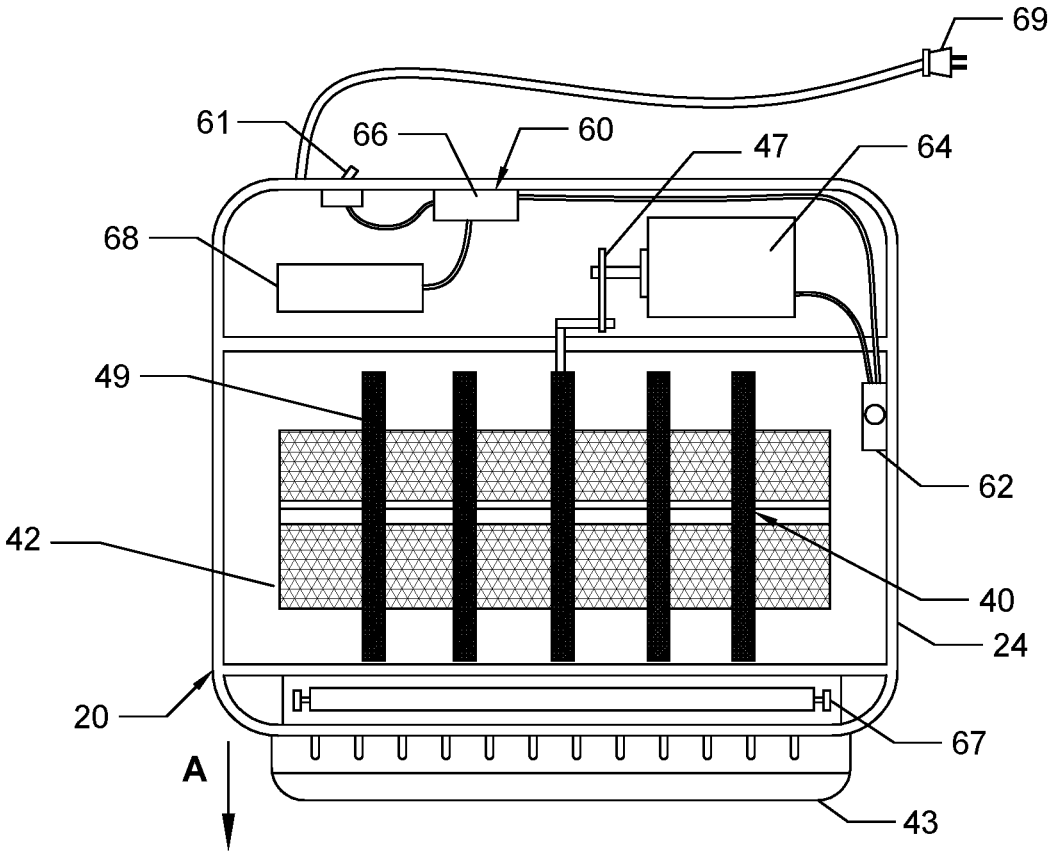
FIG. 4 depicts a top view of the present invention 10 having the top housing 22 removed and the collection tray 43 extending out of the bottom housing 24.
Figure 5:
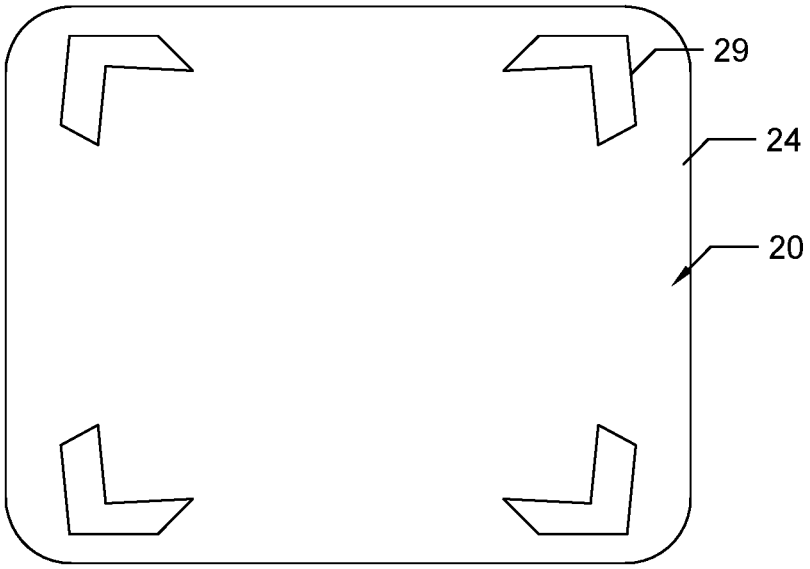
FIG. 5 shows a bottom view of the present invention 10.

Referring now to FIG. 4 it can be observed that the cleaning assembly 40 may include brushes 42, a grill 49, a shaft 47 and a collection tray 43. Brushes 42 may be connected to the electronic assembly 60 through the shaft 47. Shaft 47 may be movable and connect the electronic assembly 60 to the Brushes 42. Brushes 42 may be placed within spaces formed by the grill 49. Grill 49 may be defined by horizontally disposed metal rods. The grill 49 is located in the opening 43. Brushes 42 may move back and forth. Brushes 42 may be separated from the collection tray 43 and be sustained by means of shaft 47. It should be understood that shaft 47 may connect each of the brushes 42 therebetween. In one embodiment the brushes 42 are rectangular brushes with bristles in a top end. The brushes 42 may have such dimensions that cooperated to be placed within spaces formed by the grill 49. Brushes 42 may be made of hair, wire, metal, synthetic fibers, or any other suitable material.

The brushes 42 may be parallel placed over the collection tray 43. The collection tray 43 may transversely go through a side opening of the bottom housing 24. The collection tray 43 may be located over the bottom wall of the bottom housing 24. The collection tray 43 may preferably be made of plastic. It also may be suitable for the collection tray 43 to be made of wood, metal, or any other suitable material. In a preferred embodiment the collection tray 43 may have a rugged surface capable of collecting dirt therein. The collection tray 43 may be removed from the bottom housing 24 performing a movement A.

As best illustrated in FIG. 4 the electronic assembly 60 may include a sensor 62, a power cord 69, a motor 64, a relay 66, a battery 68, a switch 61 and a light 67. The light 67 may be located on a top bottom portion of the top housing 22. The light 67 may preferably be a light emitting diode light. It also may be suitable for the light 67 to be a liquid crystal display, or any other suitable light. The light 67 may indicate that the electronic assembly 60 is turned on. The elements of the electronic assembly 60 may be powered by means of the battery 68 or the power cord 69. The battery 68 may be a rechargeable battery. In a preferred embodiment, the power cord 69 may be used to charge the battery 68. Relay 66 may be used for protection of motor 64 from overload and electrical failure. It also may be suitable for the power cord 69 to be directly connected to the electrical power supply to provide power to the electronic assembly 60. The switch 61 may be used to turn on and turn off the electronic elements of the electronic assembly 60.

The motor 64 may be operatively connected to the shaft 47. The shaft 47 may be operatively connected to the brushes 42. The motor 64 may be actuated to produce a rotational movement. The rotational movement produced by the motor 64 may be transmitted to the brushes 42 through the shaft 47. The motor 64 may be in communication with the sensor 62. The sensor 62 may be a motion sensor. The sensor 62 may be attached to a periphery of the opening 23. The sensor 62 may detect introduction of a shoe into the top housing and actuate the motor 64 to move the brushes 42 back and forth. The grill 49 may support the shoes of the user while the brushes 42 move back and forth to clean the sole of the shoes.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shoe cleaning mat, consisting of:

a housing assembly, including a bottom housing and a top housing coupled together defining a hollow housing having an opening in a top wall thereof, wherein said bottom housing has a side opening, wherein a collection tray is introduced through said side opening;

a cleaning assembly including brushes, wherein said brushes are equidistantly disposed into said housing assembly, said brushes are connected therebetween by means of a shaft, said collection tray is beneath said brushes, said brushes are parallel to said collection tray, a grill includes rectangular elements interconnected and equidistantly separated, said grill formed in said opening by horizontally disposed metal rods defining spaces, said brushes are placed within said spaces, said grill is configured to support a weight of a user having at least one shoe; and an electronic assembly, wherein said electronic assembly includes a motor, a switch, a battery, a light, a power cord, and a sensor, said battery provides power to said motor and said sensor, said battery is a rechargeable battery, said sensor is a motion sensor, said motion sensor is attached to a periphery of said opening, said motor is configured to be actuated when said sensor detects motion, said motor is actuated to move said shaft back and forth, said motor is connected to a movable base by means of said shaft, wherein said shaft transforms a rotational movement from said motor to a linear movement, said brushes move back and forth to clean said at least one shoe, wherein said switch is operated to turn on and turn off said light, said motor and said sensor, wherein said power cord is connected to a power source to charge said battery.

* * * * *